US005148750A

United States Patent [19]

Becker et al.

[11] Patent Number: 5,148,750

[45] Date of Patent: Sep. 22, 1992

[54] UNITARY PROJECTILE

[75] Inventors: Wilfried Becker, Dusseldorf; Karl W. Bethmann, Moers; Bernhard Bisping, Ratingen; Ulrich Theis, Muelheim, all of Fed. Rep. of Germany

[73] Assignee: Rheinmetall GmbH, Düsseldorf, Fed. Rep. of Germany

[21] Appl. No.: 380,481

[22] Filed: Jul. 10, 1989

Related U.S. Application Data

[63] Continuation-in-part of Ser. No. 796,949, Sep. 23, 1985, abandoned, which is a continuation-in-part of Ser. No. 458,155, Dec. 16, 1982, abandoned, and a continuation-in-part of Ser. No. 448,508, Dec. 9, 1982, abandoned.

[30] Foreign Application Priority Data

Dec. 24, 1981 [DE] Fed. Rep. of Germany ..... 3151525

[51] Int. Cl.[5] ..... F42B 5/00; F42B 12/22; F42B 14/06

[52] U.S. Cl. ..... 102/439; 102/473; 102/491; 102/517; 102/521

[58] Field of Search ..... 102/364, 430, 439, 473, 102/491, 501, 517-523, 703

[56] References Cited

U.S. PATENT DOCUMENTS

| | | | |
|---|---|---|---|
| 1,973,604 | 9/1934 | Brandt | 102/473 |
| 3,370,535 | 2/1968 | Permutter | 102/518 |
| 3,561,363 | 2/1971 | Birkigt | 102/517 |
| 3,677,181 | 7/1972 | Giljarhus et al. | 102/364 |
| 3,834,314 | 9/1974 | Young | 102/521 |
| 3,875,864 | 4/1975 | Ambrosini et al. | 102/513 |
| 3,882,777 | 5/1975 | Rausing | 102/431 |
| 3,979,234 | 9/1976 | Northeutt, Jr. et al. | 148/126 |
| 4,015,527 | 4/1977 | Evans | 102/703 |
| 4,080,900 | 3/1978 | Augenstein et al. | 102/495 |
| 4,102,271 | 7/1978 | Bethmann | 102/521 |
| 4,208,968 | 6/1980 | Hubsch et al. | 102/513 |
| 4,249,466 | 2/1981 | Rossmann et al. | 102/513 |
| 4,280,408 | 7/1981 | Weber et al. | 102/501 |
| 4,353,302 | 10/1982 | Strandli | 102/364 |
| 4,437,409 | 3/1984 | Freymond | 102/364 |
| 4,444,114 | 4/1984 | Bisping et al. | 102/430 |
| 4,662,280 | 5/1987 | Becker et al. | 102/364 |

FOREIGN PATENT DOCUMENTS

| | | |
|---|---|---|
| 0047820 | 3/1982 | European Pat. Off. . |
| 554538 | 6/1932 | Fed. Rep. of Germany . |
| 29982 | 3/1959 | Finland . |
| 264944 | 2/1950 | Sweden . |
| 347813 | 8/1972 | Sweden . |
| 374816 | 3/1975 | Sweden . |
| 737348 | 9/1955 | United Kingdom . |
| 1214783 | 12/1970 | United Kingdom . |
| 1278546 | 6/1972 | United Kingdom . |
| 1286587 | 8/1972 | United Kingdom . |
| 1286723 | 8/1972 | United Kingdom . |
| 1507119 | 4/1978 | United Kingdom . |
| 1562021 | 3/1980 | United Kingdom . |

*Primary Examiner*—Harold J. Tudor
*Attorney, Agent, or Firm*—Spencer, Frank & Schneider

[57] ABSTRACT

A unitary ammunition unit comprising a propellant charge. An explosive sub-caliber projectile having a pull-drive type of sabot is mounted on the propellant charge. The sub-caliber projectile is at least partially formed of a heavy-metal-sinter alloy of high density.

8 Claims, 3 Drawing Sheets

UNITARY PROJECTILE

CROSS REFERENCE TO RELATED APPLICATION

This application is a continuation-part application of our copending application Ser. No. 736,949 filed Sep. 23, 1985, now abandoned, which is in turn a continuation-in part application of our copending application Ser. No. 458,155 filed on Dec. 16, 1982 (now abandoned) and of Ser. No. 448,508, filed on Dec. 9, 1982 now abandoned.

BACKGROUND OF THE INVENTION

Certain types of full-caliber projectiles are, for example, described in the Rheinmetall Waffentechnisches Taschenbuch 3rd Edition, 1977, page 502, picture No. 1125. These full-caliber projectiles have, as a result of their cross-section, a large free flow or stream velocity so that, due to the thereby resulting velocity decrease, large combatting distances can only be achieved over a correspondingly curved flight path and the time period corresponding thereto. This is, above all, particularly disadvantageous when rapidly moving targets are to be combatted by the use of fragment-effects and gas-shock effects.

SUMMARY OF THE INVENTION

It is an object of this invention to provide a projectile or ammunition of the aforedescribed-described type, which distinguishes itself by being capable of achieving a substantially extended flat flight path.

BRIEF DESCRIPTION OF THE DRAWINGS

The object of the invention is achieved by way of four different examplary projectiles which are illustrated in the accompanying drawing in substantially schematic form. Details which are not essential to an understanding of the invention have been omitted in the preferred embodiments illustrated hereinafter, which are shown by example only. Those parts of the projectiles of the four embodiments of the invention which are equivalent have been designated with the same reference numbers.

DETAILED DESCRIPTION

Figure 1:
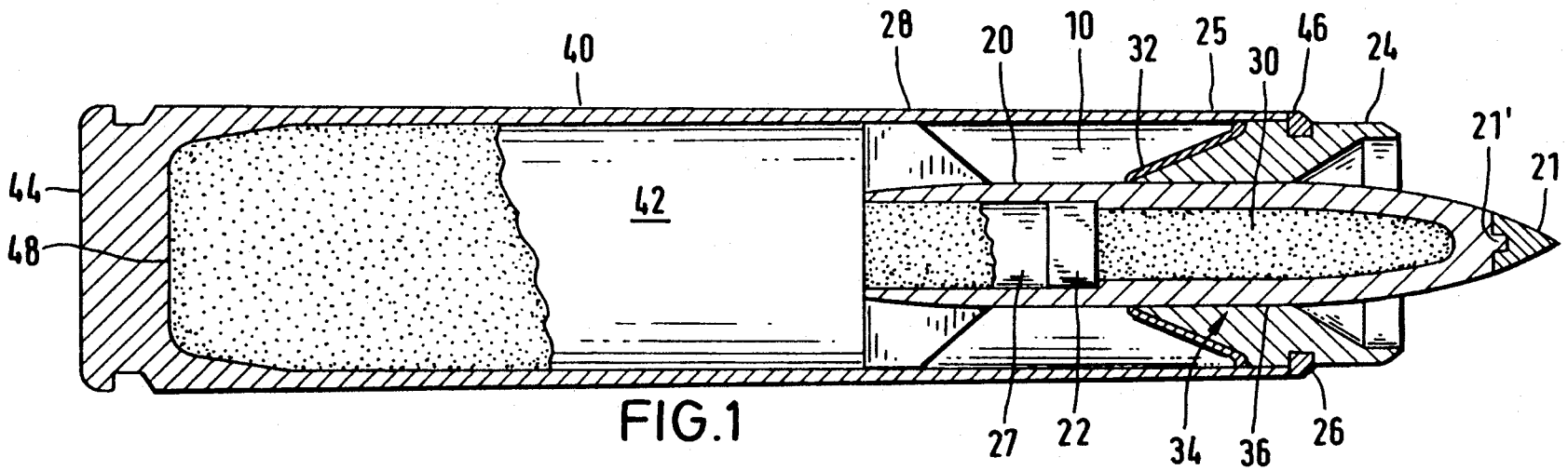
FIG. 1 is a longitudinal axial cross-sectional view of the first embodiment of the invention of a flight-stabilized projectile having a propellant charge casing.
Figure 2:
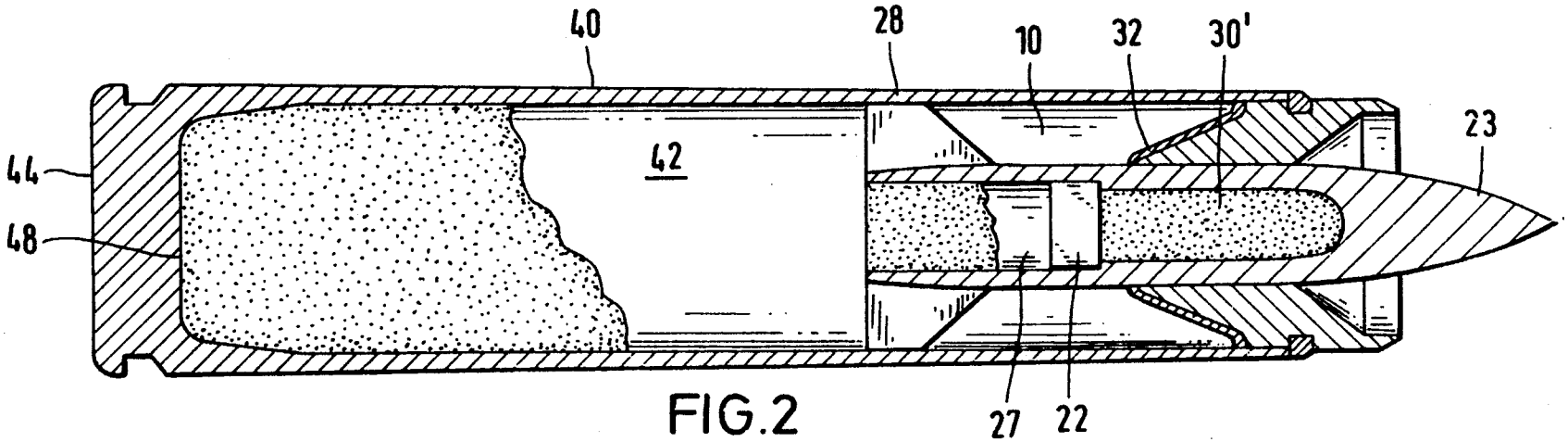
FIG. 2 is a longitudinal axial cross-sectional view of a second embodiment of a flight-stabilized projectile having a propellant charge casing.

The ammunition units illustrated in FIGS. 1 and 2 include a subcaliber explosive projectile 10 having a splinter-forming projectile casing 20 made of sinter-alloy having a high content of heavy metal, preferably tungsten and/or at least one other component of high density e.g. depleted uranium; the minimum density of the alloy forming the casings is 17 gm ($cm^3$). Such alloy can advantageously have a 90% by weight tungsten content forming part of a metal alloy matrix containing also nickel and iron. The projectile casing 20 is provided on its periphery with a pull-drive-sabot 24 that is made up of a plurality of segments in a manner not illustrated in detail. As can be noted from FIGS. 1 and 2 the gas pressure receiving surface 32 of the sabot 24 extends forwardly far into a front region of the projectile. The pull-drive-sabot 24 is provided with a form-locking zone 34 (which zones include mutually corresponding non-illustrated form locking means in the region of a peripheral radially inwardly facing surface 36 of the sabot 24 and an immediately adjoining radially outwardly facing counter surface 25 of the casing 10), with which peripheral surface 36 the projectile casing 20 forms an actual form lock during traverse through the propellant charge casing 40. The projectile 10, in accordance with FIG. 1, includes a front part 21 which is made up of, for example, a reactive substance, which is joined via a pin 21' with the projectile casing 20. The ring-portion of the pull-drive-sabot 24 is surrounded by a guide band 26. The projectile casing 20 contains an explosive detonating charge 30. A bottom igniter 22, which is not illustrated in detail, is disposed rearwardly in the projectile casing 20. A rearwardly disposed inner chamber 27 is, for example, provided for a non-illustrated tracer composition or any other suitable arrangement. The propellant charge casing 40, in which the projectile 10 is mounted, has a circular cross-section the exterior diameter of which is substantially uniform over its entire axial length extending from the casing bottom 44 forwardly to a forward-most annular end surface 46. Such a construction makes a very favorable packaging volume, some of the advantages of which are described in the above-identified copending U.S. Pat. application Ser. No. 448,508 filed Dec. 9, 1982, which is the parent of U.S. Pat. application Ser. No. 279,236, filed Nov. 29th, 1988, now U.S. Pat. No. 4,955,938 issued Sep. 11th, 1990.

The embodiment of FIG. 2 has a comparatively smaller explosive charge 30' which represents a modification in which, the entire front region 23 is made up of the same high density substance out of which the casing 20 is made.

Figure 3:
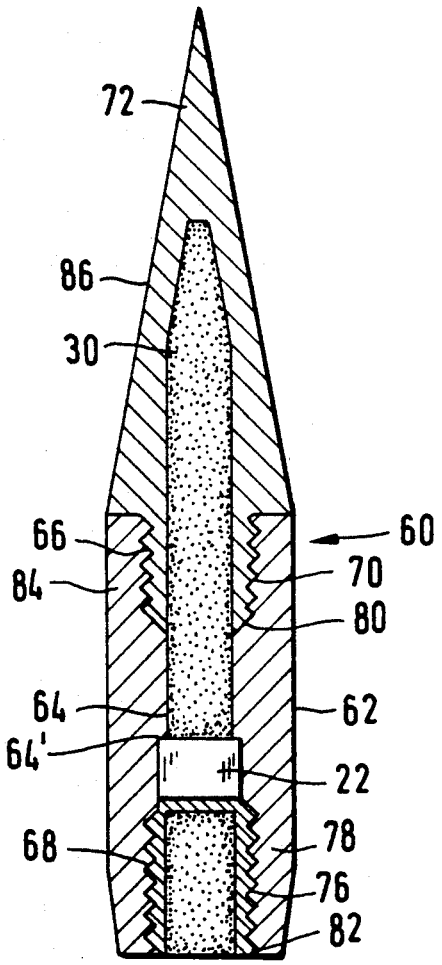
FIG. 3 is a cross-sectional longitudinal axial view of a third embodiment of a projectile which is spin-stabilized.

The embodiment of FIG. 3 includes a jacket 62 which is rotation-symmetrically shaped and includes a central bore 64 as well as a forward and rearward attachment region 66 and a shoulder 64'. In the rear region of the bore 64 there is disposed a bottom igniter 22, which forwardly abuts against the shoulder 64' and rearwardly adjoins an axial chamber of a threaded member 76', the chamber 76' is in the form of a blind bore and holds a tracer composition 78. The threaded member 76 is mounted in the jacket 62 by means of a threaded portion 82 which is mounted in the threaded bore of the rearward attachment region 68 of the jacket 62. The front body includes a hollow chamber 86 which constitutes an extension of the hollow chamber defined by the bore 64 and which bore 64 and chamber 86 serve for holding an explosive charge 30.

Figure 4:
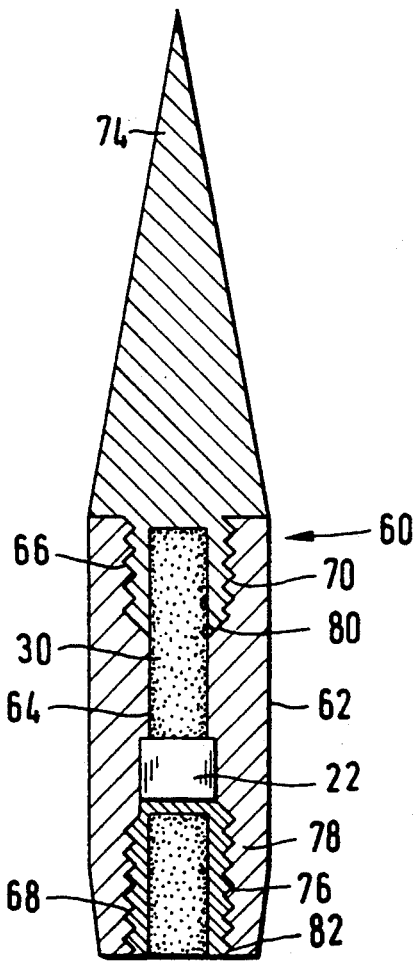
FIG. 4 is a cross-sectional longitudinal axial view of a fourth embodiment of a projectile which is spin-stabilized.

FIG. 4. illustrates a projectile having a massive front body 74 which provides for an increased penetration capability, for example, a penetration capability that is suitable for armored targets. In both of the embodiments of FIGS. 3 and 4, the substance of the front bodies 72 and 74 can correspond to that of the casing 60, in particular with respect to its density.

Advantageously both embodiments, according to FIGS. 3 and 4, have identical casing bodies 60 (made of an alloy as described with respect to the casings 20 of the embodiment of FIGS. 1 and 2), whereby selectively they can be combined with one or the other of the front bodies 72 and 74 depending on the target character. Thereby by means of a simple modular construction a very simple and inexpensive ammunition unit is provided.

The front bodies 72, 74 have rearwardly extending threaded pins 66 which are threadably mounted in threaded mating bores 70 in the jacket 62. After the corresponding front body 72, respectively 74, has been screwed onto the casing body 60 the finishing of the ammunition is achieved by inserting in the rearward portion the detonating charge 30. Thereafter the bottom igniter 22 is inserted and fixed by being screwed in the member 76 for holding the tracer composition 7B.

In view of the high density and the sub-caliber character of the explosive projectile 10 or 60 (the latter having a comparatively smaller free flow or stream velocity) the projectile 10, 60 acquires a substantially extended flight path, so that it becomes more suitable for combating rapidly moving targets by utilizing their fragment effect and gas-impact effect. By using an adjustable-delayed bottom igniter 22 it is also possible to successfully combat light and up to middle-heavy armored targets with the explosive projectile 10, 60.

The bottom igniter 22 can take various forms. For example it can be a mechanical time fuse which can be selectively actuated; it can be a pyrotechnic time-delay fuse with a reinforcing charge, which develops a high temperature at an impact-ignition for the main explosive charge, or it can be a known proximity fuse.

Figure 5:
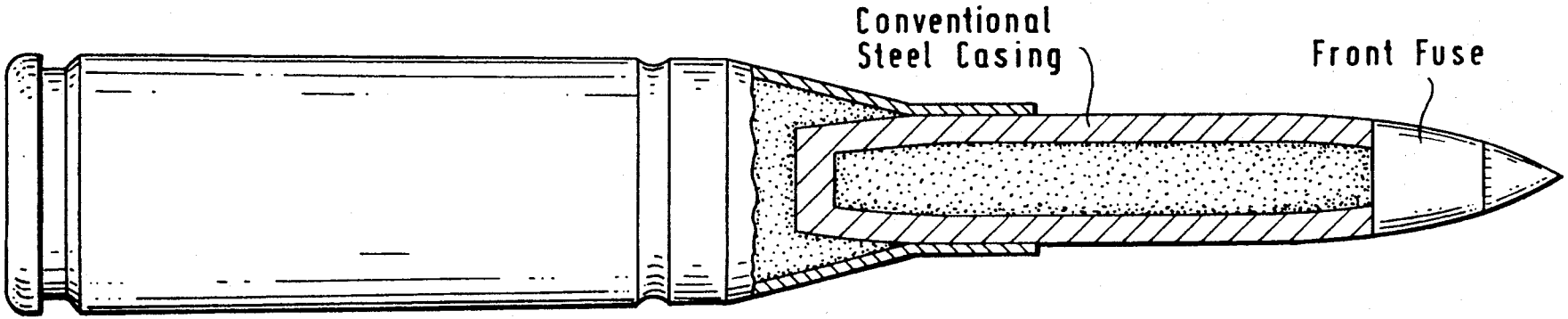
FIGS. 5 and 5*a* are respective cross-sectional side elevational view of a conventional ammunition unit and an ammunition unit in accordance with this invention; said two ammunition units are shown side by side and are of equal axial length and equal caliber.
Figure 5A:
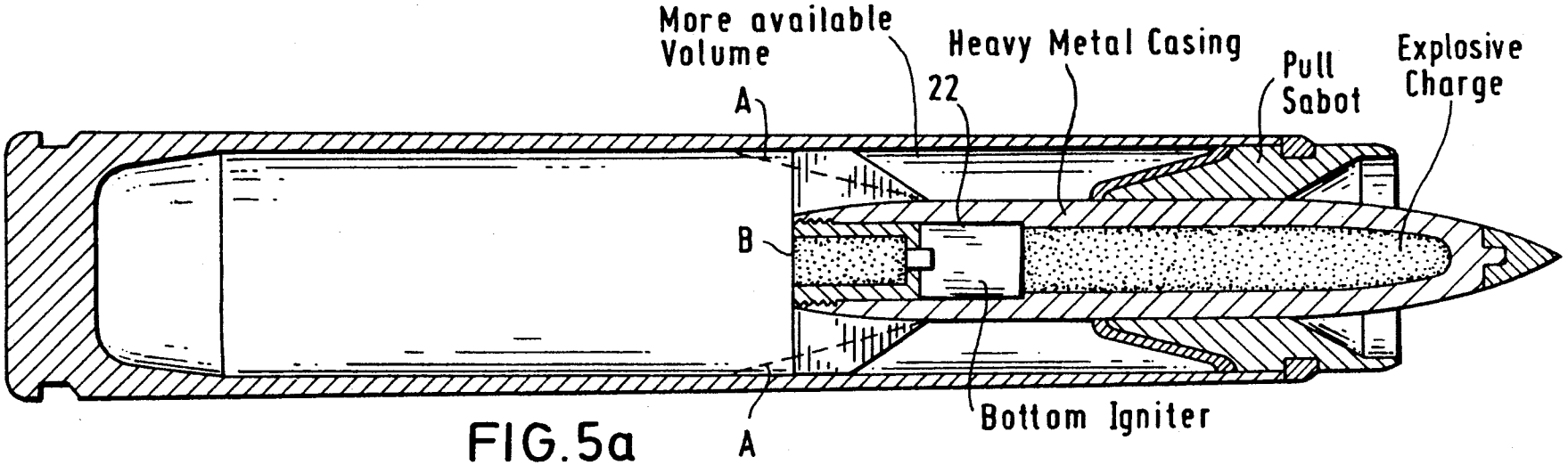

The ammunition unit of FIG. 5 represents a conventional explosive projectile having the conventional steel casing and nose (time fuse or impact fuse). This conventional explosive projectile is mounted on a "bottle-shaped" propellant charge casing. In FIG. 5*a* there is shown a fin-stabilized explosive projectile and an especially shaped propellant charged casing, the combination of which forms the subject of this invention. The propellant charge casing and projectile have the same axial length and same caliber as the conventional projectile and casing illustrated in of FIG. 5. The projectile of FIG. 5*a* is provided with a pull-drive sabot. The volume of the propellant charge casing defined forwardly by the rear surface of the pull-drive sabot and rearwardly by the dashed lines A represents the volume available for additional propellant charge powder which is not available in the conventional ammunition unit of the prior art as shown in FIG. 5.

Moreover, the fin-stabilized projectile of the invention includes a bottom fuse B. The projectile itself is made of a casing of tungsten-heavy metal.

In view of the fact that the projectile of the invention is made of tungsten-heavy metal, there is required, for purposes of obtaining an initial firing velocity of equal magnitude compared to the conventional explosive projectile of equal size, having a steel casing, a somewhat higher acceleration energy, and thus a somewhat higher propellant charge mass. By combining an especially constructed propellant charge casing with a specially constructed pull sabot, the invention enlarges the available propellant charge mass for the casing thereby making it possible to increase the initial velocity even beyond that required to make it comparable to that of a conventional explosive projectile as illustrated in FIG. 5.

During the flight of the projectile of the invention the "heavy" projectile because of its high kinetic energy encounters also less air resistance and is therefore less braked. At target impact there is produced a swarm of very small splinters made of tungsten-heavy metal, which, as a result of their high kinetic energy, have a particularly pronounced destructive effect. All of this becomes part of the efficacy of the explosive projectile in accordance with this invention compared to a conventional explosive projectile such as illustrated in FIG. 5.

It should be noted that the bottom fuse 22, may include means for adjustably providing a time delay ignition. However, the bomb fuse 22 can also be in the form of an impact fuse, mechanical or pyrotechnical time delay fuse or possibly also a proximity fuse. Such fuses are known in the art and do not form part of this invention. A selection of a particular type of fuse depends on what target the projectile is used against. For example, for flying targets a proximity fuse is generally used because a direct hit is not generally required. Such flying targets are combatted with an explosion in the vicinity of or having a corresponding effect against a flying target.

A tracer charge B can also be supplied as shown in FIG. 5*a*. When such tracer charge is being used it is recommended to use an impact fuse with pyrotechnical self-destruct charge in case of a target miss. Thereby, due to the ignition of the tracer charge there is first ignited a time delay charge then a reinforcing charge for initiating the explosion of the main charge.

It is important that the fuse is in the form of a bottom fuse so that the forwardly disposed massive or solid nose of the casing has a corresponding forwardly direct penetration effect and the splinters of the tungsten-heavy metal casing have as destructive as possible an effect at impact.

The projectiles of this invention provide some significant advantages over the prior art. These advantages are particularly significant when comparing the fin-stabilized subcaliber projectiles of FIGS. 1 and 2 with the prior art projectiles. The following novel combinations of features bring about these advantages: the projectile casing 20 is made of a heavy metal alloy of high density such as tungsten; the projectile has a massive nose 23 which causes the center of gravity of the projectile to be situated forwardly relative to the state of the art projectiles; such a projectile also has improved flight stability; since the projectile is a subcaliber projectile it has an increased ballistic range with reduced air resistance braking due to its relatively reduced caliber but large mass (high specific weight); the explosive charge and igniter effect an immediate projectile disintegration into a swarm of splinters; high muzzle exit velocity and therefore shortened flight to target; guide fins for flight stabilization; the cylindrical shape of the projectile and the forward mounting of the sabot make possible a larger volume of propellant charge powder per projectile mass as compared to a conventional projectile with conventional bottle-shaped casing of equal length. As a result of the end-ballistic increase in capability which results from the aforegoing projectile there is furnished a further capability-increasing step, to wit, the possibility of making the propellant charge casing at least partially combustible or providing a projectile having no propellant charge casing, whereby the propellant charge body can be combined with the projectile of the invention to form a unitary construction, so that the utilization of empty spaces is reduced or completely avoided.

The bottom igniter 22 is a fuse which may take several forms. The type of fuse used as the bottom igniter is described in detail in the Rheinmetall HANDBOOK ON WEAPONRY, 1982 Edition, pages 608–619. The bottom igniter 22 may, for example, be on impact self-destruction base fuse, a time base fuse or a proximity fuse.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

We claim:

1. A fin-stabilized sabot subcaliber explosive projectile ammunition comprising:

a pull-drive sabot means;

a splinter-forming projectile body having a fin-stabilization means adjacent a rear end thereof carried by said sabot means;

said projectile body having a blind bore axial channel means which extends from an open rear end of said projectile body forwardly to a solid nose portion thereof and being made of a tungsten sinter alloy having a density of at least 17 grams/cm$^3$; the tungsten content of said sinter alloy being at least 90% by weight and said sinter alloy forming a matrix which includes, in addition to tungsten, iron and nickel;

said ammunition further including a cylindrical propellant charge casing which has an open front end;

said sabot means being mounted on said front end of said casing with a portion of said sabot means and a portion of said projectile body extending forwardly of said front end of said casing;

a bottom igniter operatively mounted in said channel means; and an explosive charge, for fragmenting said body and ignited by said bottom igniter, disposed in said channel means between said bottom igniter and said solid nose portion.

2. In an ammunition unit including an explosive subcaliber projectile provided with a discardable sabot which is mounted in a front end of a cylindrical shaped propellant charge casing, the improvement wherein:

said explosive projectile has a body made of a heavy metal sintered alloy having a content of at least 90% by wt. of tungsten, with said projectile body having a central blind bore which is rearwardly open and a solid nose portion;

an explosive charge for fragmenting said body is disposed forwardly in said central bore and a bottom igniter for said explosive charge is mounted rearwardly relative to said explosive charge in said bore and has an adjustable actuation delay;

said discardable sabot is operatively mounted on said projectile and said sabot is also operatively mounted on said propellant charge casing;

said sabot is a pull-drive sabot and includes a gas pressure receiving surface means which extends substantially forwardly; and the front end of said cylindrical propellant charge casing is closed by said projectile and sabot mounted thereon thereby providing a favorable volume accommodating a propellant charge in said casing, which volume extends from a rear bottom of said casing up to said forwardly extending gas pressure receiving surface means of said sabot.

3. The ammunition unit of claim 2, wherein said projectile has a tail portion and a fin-stabilization means mounted thereon.

4. An ammunition unit comprising:

an explosive fin stabilized subcaliber projectile including a projectile body formed of a heavy metal sintered alloy if high density containing a large amount of tungsten, an axial blind bore which extends from an open rear end of said projectile body to a solid front portion of said body, an explosive charge for fragmenting said body disposed in and substantially filling a portion of said axial bore extending from said front portion, a bottom igniter for said explosive charge disposed in said bore rearwardly relative to said explosive charge, and a fin stabilization means mounted on a rear portion of said projectile body;

a pull-drive sabot mounted on said projectile body and having a gas pressure receiving surface which extends substantially forwardly relative to said projectile body; and a cylindrical propelling charge casing having an open front end, said sabot and said projectile being mounted in and closing said front end of said propelling charge casing to provide a favorable volume for a propelling charge in said propelling charge casing with said volume extending from an interior bottom surface of said propelling charge casing to said forwardly extending gas pressure receiving surface of said sabot.

5. An ammunition unit as defined in claim 4 wherein said alloy has a density of at least 17 grams/cm$^3$.

6. An ammunition unit as defined in claim 5 wherein said alloy includes at least 90% by weight of tungsten.

7. An ammunition unit as defined in claim 4 wherein said bottom igniter has an adjustable actuation delay time.

8. An ammunition unit as defined in claim 4 wherein said solid front portion of said projectile body comprises a massive front portion which extends to a front tip of said projectile.

* * * * *